US009062470B2

(12) United States Patent
Mockry et al.

(10) Patent No.: US 9,062,470 B2
(45) Date of Patent: Jun. 23, 2015

(54) SHELL EXTENSION FOR NATURAL DRAFT COOLING TOWER

(71) Applicant: SPX Cooling Technologies, Inc., Overland Park, KS (US)

(72) Inventors: Eldon Mockry, Lenexa, KS (US); Eric Rasmussen, Overland Park, KS (US); Kathryn L. Pullen, Lenexa, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 0 days.

(21) Appl. No.: 13/922,881

(22) Filed: Jun. 20, 2013

(65) Prior Publication Data

US 2014/0373466 A1 Dec. 25, 2014

(51) Int. Cl.

| | |
|---|---|
| ***B01F 3/02*** | (2006.01) |
| ***B01F 3/04*** | (2006.01) |
| ***E04H 5/12*** | (2006.01) |

(52) U.S. Cl.

CPC ..... *E04H 5/12* (2013.01); *Y10T 29/49627* (2015.01); *Y10S 261/03* (2013.01); *B01F 3/02* (2013.01); *Y10S 261/11* (2013.01)

(58) Field of Classification Search

CPC ..... B01F 3/02; B01F 3/04; B01F 3/068; Y10S 261/03; Y10S 261/11

USPC ..... 52/245, 247, 260, 745.03, 745.04, 52/745.07; 261/DIG. 11, 109, 111

See application file for complete search history.

(56) References Cited

U.S. PATENT DOCUMENTS

| | | | | |
|---|---|---|---|---|
| 3,300,942 | A * | 1/1967 | Horstman | 52/745.09 |
| 3,385,197 | A * | 5/1968 | Greber | 454/38 |
| 3,618,277 | A * | 11/1971 | Waters | 52/175 |
| 3,637,193 | A * | 1/1972 | Kugler et al. | 261/24 |
| 3,846,519 | A * | 11/1974 | Spangemacher | 261/151 |
| 3,944,636 | A * | 3/1976 | Schuldenberg et al. | 261/159 |
| 3,994,108 | A * | 11/1976 | Johnson | 52/247 |
| 4,092,811 | A * | 6/1978 | Lin et al. | 52/223.3 |
| 4,148,850 | A * | 4/1979 | Schulte et al. | 261/109 |
| 4,261,931 | A * | 4/1981 | Rothrock et al. | 261/109 |
| 4,267,883 | A * | 5/1981 | Maurice et al. | 165/129 |
| 4,326,363 | A * | 4/1982 | Leonhardt et al. | 52/223.3 |
| 4,397,793 | A * | 8/1983 | Stillman et al. | 261/30 |
| 4,520,600 | A * | 6/1985 | Bordet | 52/83 |
| 4,737,321 | A * | 4/1988 | McCloskey et al. | 261/109 |
| 5,480,594 | A * | 1/1996 | Wilkerson et al. | 261/109 |
| 6,497,401 | B2 * | 12/2002 | Flaherty | 261/109 |
| 6,943,461 | B2 * | 9/2005 | Kaploun | 290/43 |
| 8,235,363 | B2 * | 8/2012 | Samyn et al. | 261/108 |

* cited by examiner

*Primary Examiner* — Phi A

(74) *Attorney, Agent, or Firm* — Baker & Hostetler LLP

(57) ABSTRACT

A system for increasing a cooling capacity of a cooling tower includes a shell extension and a tensioner. The shell extension is to extend a height of the cooling tower. The tensioner is to provide a tensioning force from the shell extension to a base of the cooling tower.

10 Claims, 7 Drawing Sheets

SECTION A-A

SHELL EXTENSION FOR NATURAL DRAFT COOLING TOWER

FIELD OF THE INVENTION

The present invention generally relates to a cooling tower. More particularly, the present invention pertains to a natural draft cooling tower.

BACKGROUND OF THE INVENTION

Many types of industrial facilities, such as for example, steam power plants, require condensation of the steam as integral part of the closed steam cycle. Both wet and dry type cooling towers have been used for condensing purposes. Wet cooling towers are preferred when sufficient water resources are available as wet cooling is more energy efficient than dry cooling. However, as wet cooled systems consume a considerable amount of cooling water, dry cooling systems have gained a growing market share because of their ability to save water resources. In particular, forced draught dry air-cooled condensers consisting of a multitude of fin tube heat exchangers have been known for many years. Contrary to wet cooling arrangements, which are characterized by a secondary cooling water loop, these systems are so-called "direct" dry systems where steam is directly condensed in the fin tube heat exchangers by air cooling. The fin tube heat exchangers are mounted with the tube center lines arranged in a position inclined to the vertical direction. The bundles are mounted to a support structure which enables cooling air to be conveyed through the fin tube heat exchangers by means of fans. Ambient air in contact with the fin tube heat exchangers condenses the steam inside the fin tubes, which then exits the heat exchanger as condensed sub-cooled liquid. Although being commercially successful over many years, a disadvantage of direct dry air-cooled condensers is the power required to operate the fans, as well as fan noise, which is undesirable in most situations. Currently two types of dry cooling are used, air-cooled condenser (ACC) natural draft or fan assisted, and indirect dry cooling tower (IDCT) natural draft or fan assisted.

In an indirect dry cooling system, a turbine exhaust condenser is provided, where turbine steam is condensed by means of cooling water. The cooling water is conveyed through a water duct by means of a pump to an air-cooled cooling tower. An indirect dry cooling tower consists of a multitude of air-cooled heat exchangers where the heat is conveyed to the ambient air by convection. The cooling tower may be operated with fan assistance or in natural draught. The turbine exhaust condenser may for example be a surface or a jet condenser. Because of the presence of a secondary water loop, indirect dry cooling systems are not as thermally effective as direct dry systems. Another disadvantage of natural draught indirect dry cooling systems, however, is the higher investment cost as compared to the forced draught direct air cooled condenser.

These natural draft cooling towers are generally from 100 meters to 200 meters high or more and 75 to 150 meters or more in diameter. In general, the larger the towers are, the more heat they are capable of dissipating. However, if the plant is modified to produce more energy or otherwise need more cooling capacity, it is very difficult to increase capacity to a natural draft cooling tower. Adding heat transfer media whether wet or dry may not increase cooling. By adding depth to the heat exchangers the resistance to air flow is increased. The total airflow through a natural draft tower is reduced and thermal performance may actually be diminished. More airflow may be needed to increase thermal performance.

Accordingly, it is desirable to provide a system and method to increase the cooling capacity of a cooling tower that is capable of overcoming the disadvantages described herein at least to some extent.

SUMMARY OF THE INVENTION

The foregoing needs are met, to a great extent, by the present invention, wherein in some respects a system and method to increase the cooling capacity of a cooling tower are provided.

An embodiment of the present invention pertains to a system for increasing a cooling capacity of a natural draft cooling tower. The system includes a shell extension and a tensioner. The shell extension is to extend a height of the cooling tower. The tensioner provides compression in the structure from the shell extension to a base of the cooling tower.

Another embodiment of the present invention relates to an apparatus for increasing a cooling capacity of a cooling tower. The apparatus includes a shell extension and a tensioner. The tensioner provides compression in the structure from the shell extension.

Yet another embodiment of the present invention pertains to a method of increasing a cooling capacity of an existing cooling tower. In this method, a shell extension is installed to extend a height of the existing cooling tower and it is determined if a wind load of the shell extension and the existing cooling tower is less than a designed wind load of the existing cooling tower.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 1 is an elevation view of a cooling tower suitable for use with a shell extension system according to an embodiment of the invention.

DETAILED DESCRIPTION

Figure 2:
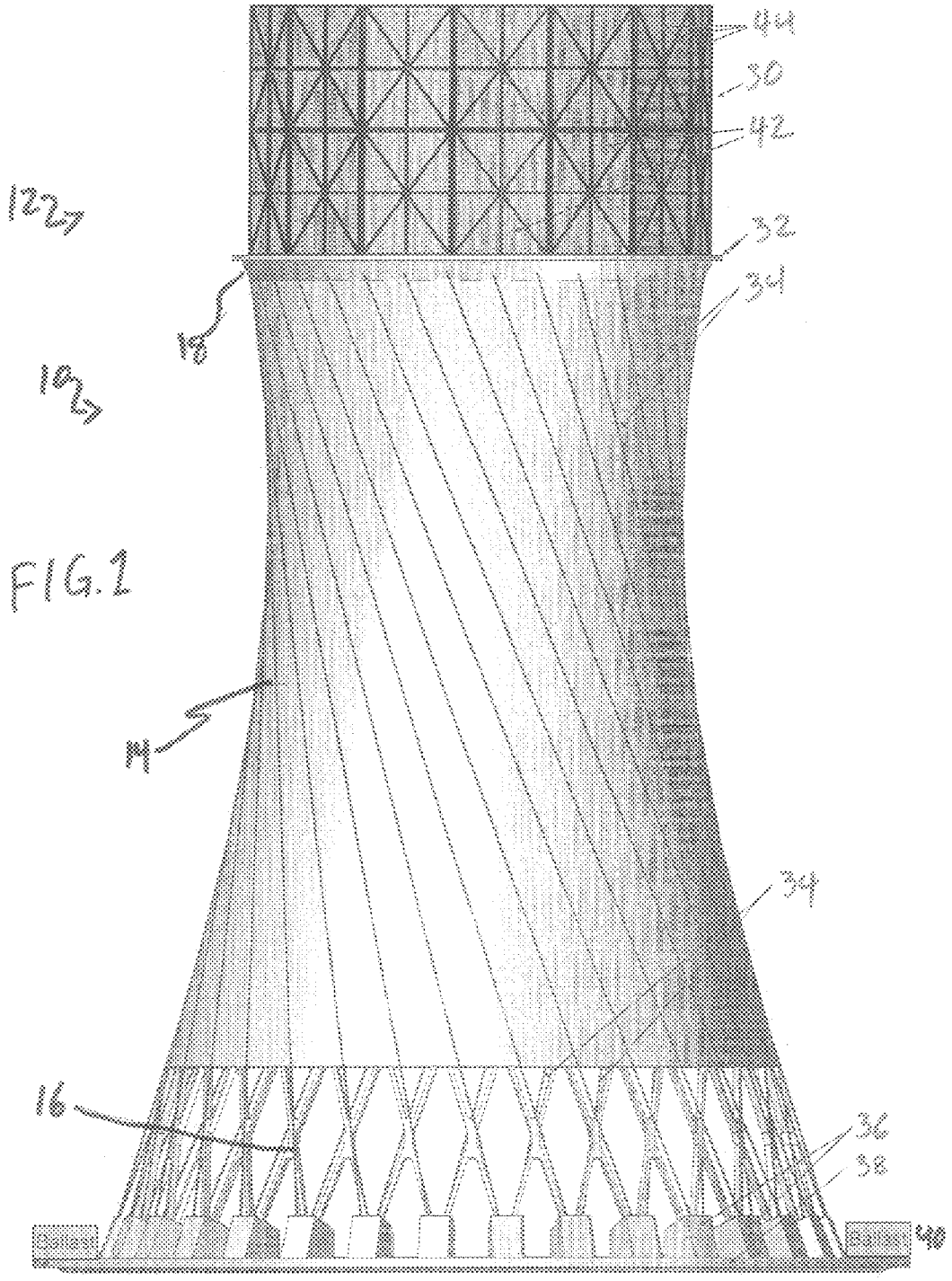
FIG. 2 is a hidden-line, elevation view of the cooling tower suitable for use with the shell extension system of FIG. 1.
Figure 2:
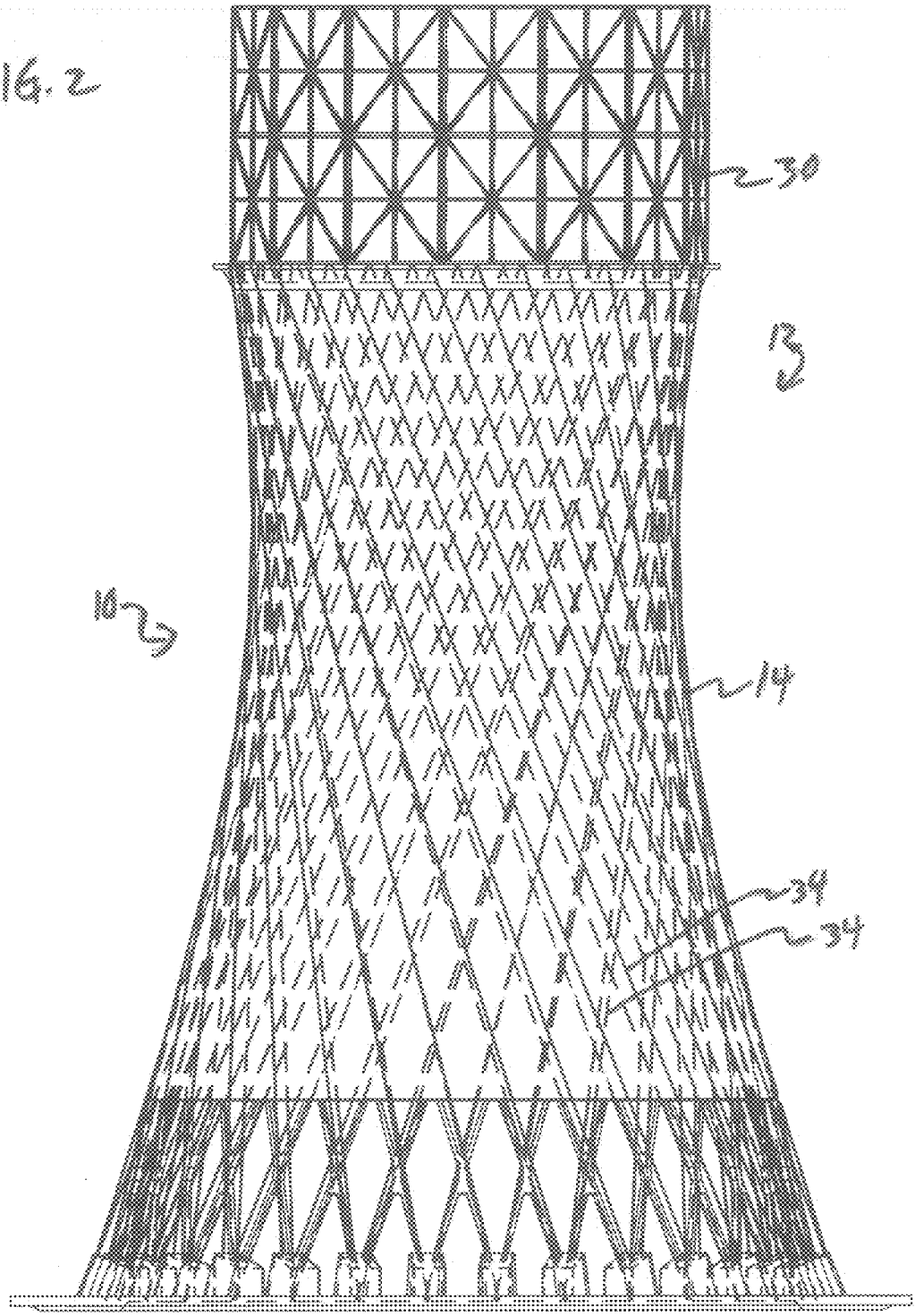

The present invention provides, in various embodiments, a system and method to increase the cooling capacity of a cooling tower suitable for use with a power generating facility. Embodiments of the invention will now be described with reference to the drawing figures, in which like reference numerals refer to like parts throughout. FIG. 1 is an elevation view of a cooling tower 10 suitable for use with a shell extension system 12 according to an embodiment of the invention. As shown in FIG. 1, the cooling tower 10 includes a shell 14 with X-columns 16 and a rim 18. The shell 14 is manufactured from any suitable material and may include any suitable shape. In general, suitable materials include reinforced concrete, metal, and the like. Suitable shapes include hyperboloid, cylindrical, etc. The columns 16 or other such support structure is configured to allow air to enter at the base of the cooling tower 10. Columns may alternately be configured in V's or so called meridional columns which are radially oriented. The air is warmed by passing through the heat exchanger and rises through the cooling tower 10 to exit from the rim 18.

The shell extension system 12 includes a shell extension 30, stiffening ring 32, tensioners 34, plinths 36, ring beam 38, and ballast 40. The shell extension 30 includes a panel or membrane 42 supported by a frame 44. The shell extension system 12 may be installed as part of a new cooling tower construction and/or on an existing cooling tower. In both installations, the shell extension system 12 increases the cooling capacity of the cooling tower 10. It is an advantage of one or more embodiments of the invention that this increased cooling capacity or increased capacity to dissipate heat may be realized without building additional cooling towers or demolishing existing towers and rebuilding them larger. It is another advantage that the shell extension system 12 described herein may be installed more quickly and efficiently than a concrete extension and a portion may be assembled on the ground to further reduce energy plant down time. In addition, the extension described herein may be less expensive to build. Furthermore, the shell extension 30 may be extremely corrosion resistant. For example, the membrane 42 may include a polytetrafluoroethylene (PTFE), polyvinyl chloride (PVC), or other polymer sheet or fabric.

Natural draft (ND) cooling tower performance is influenced by the height of the tower shell 14. The cooling tower 10 and other ND towers work by creating a pressure differential of the column of air in the shell 14 versus the air stratum on the outside of the shell 14. The ambient air on the outside of the shell 14 may be thought of as a column of ambient air creating a head pressure. This column of air exerts a pressure at the air inlet around the columns 16. Ambient air entering the cooling tower 10 is heated and gains moisture as it passes through the heat exchanger (not shown). This makes the air more buoyant than the outside air. The inside air column exerts less pressure. This pressure differential causes the ambient air to move into the tower and through the heat exchanger.

More air flow results in more cooling. The airflow is roughly proportional to the square root of the pressure differential. By creating a taller tower, the column of air is also taller and the differential pressure is approximately increased linearly. Therefore, the airflow increases approximately by a factor of the square root of the ratio of the total height of the extended tower to the tower height of the original shell 14.

It is another advantage of some embodiments that a deteriorated top portion or the rim 18 of the cooling tower 10 or other existing ND tower may be replaced during installation of the shell extension system 12. In this regard, older shells 14 may have experienced significant deterioration. In some cases, the rim 18 or top of the shell 14 is significantly more deteriorated than the lower portion of the shell 14. Effluent air discharged from the cooling tower 10 is nearly all pure water vapor. Wind tends to bend the plume over the top of the cooling tower 10 and some of the vapor may condense on the outside of the shell 14—particularly at the rim 18. This condensate dries out when the plume changes direction. Thus, the outside of the shell 14 is exposed to many wet dry cycles of this condensed vapor. Vapor condensate aggressively solubilizes and leaches out constituents from the concrete which causes the concrete to weaken and crumble.

Additionally, many shells 14 flare out above the throat (minimum diameter location) as shown in FIG. 1. The concrete in the circumferential direction is in tension under its own dead weight. Any cracks oriented vertically tend to stay open as a result of the tension forces and that makes the reinforcing steel more vulnerable to corrosion. Below the throat, the concrete is in compression under its own dead weight and any cracks present tend to close under the compression.

Figure 6:
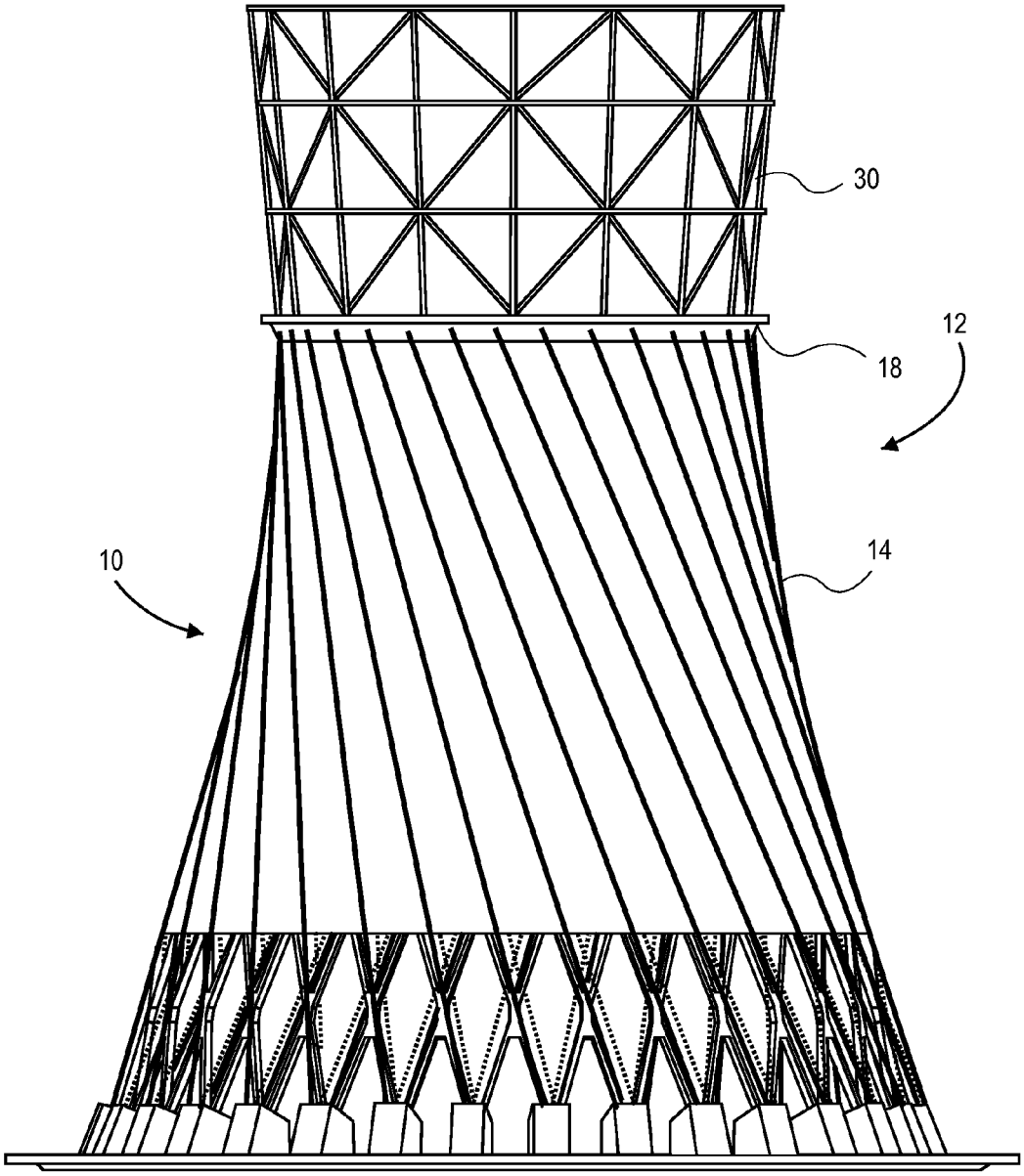
FIG. 6 is an elevation view of another example of the shell extension according to FIG. 1.
Figure 7:
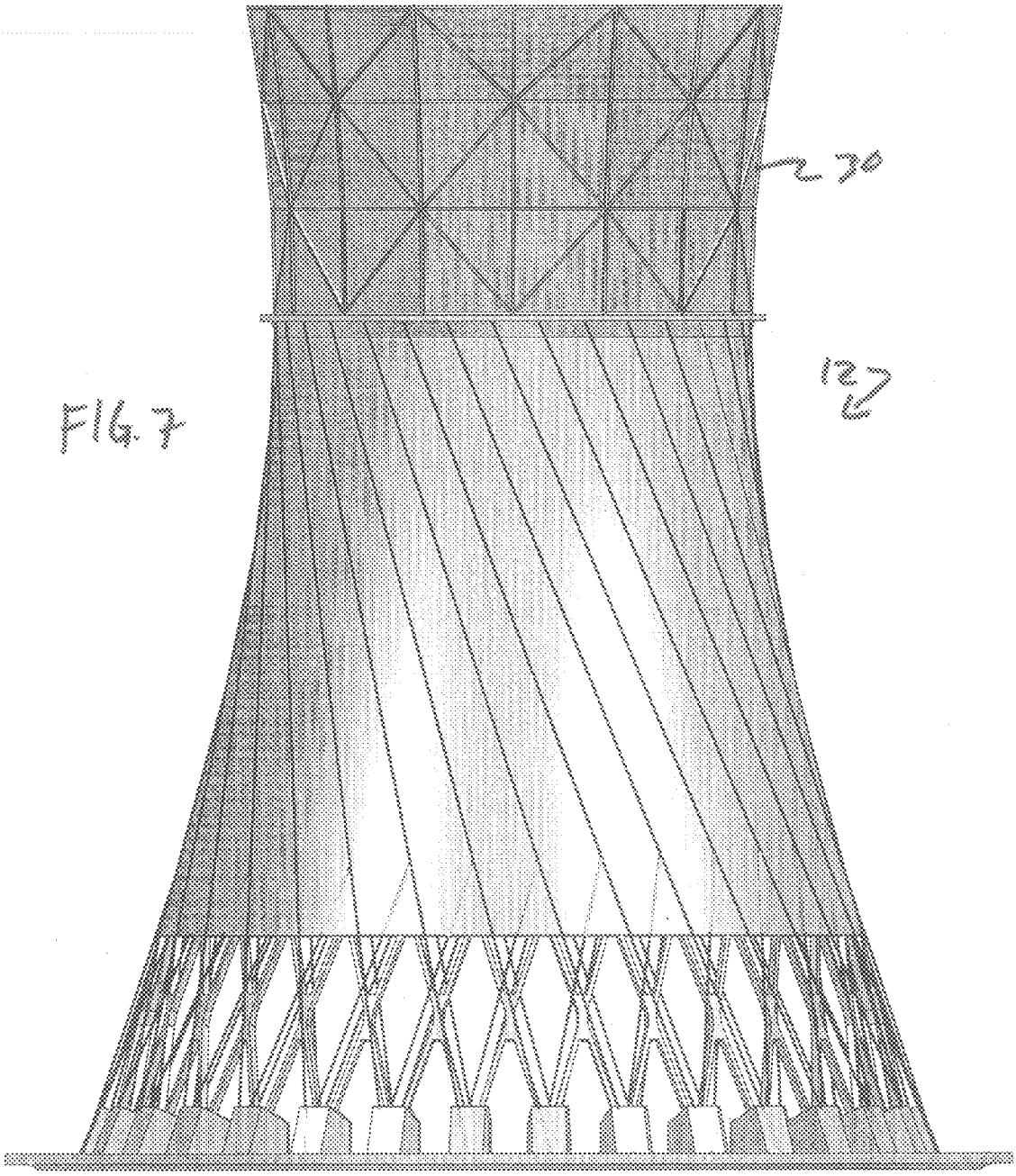
FIG. 7 is an elevation view of yet another example of the shell extension according to FIG. 1.

The shell extension 30 shown in FIG. 1 is generally cylindrical in shape. However, other shapes are within the purview of this and other embodiments of the invention. For example, as shown in FIG. 6, the shell extension 30 may include an inverted, truncated cone. The angle of the inverted, truncated cone may be approximately the average slope of that section of the hyperbola of revolution of the cooling tower 10 projected along the height of the shell extension 30. In yet another example shown in FIG. 7, the shell extension 30 may include a hyperboloid shape that generally continues the geometric shape of the cooling tower 10. However, if the slope diverges too steeply, the airflow may separate from the wall, and the effective shell height will diminish. In a particular example, the shell extension 30 angle is about 10 degrees or less from the vertical. In a more specific example, the angle of the shell extension 30 is about 3 to 4 degrees from the vertical (6 to 8 degree included angle). As such, on a cooling tower with a slope at the discharge greater than 3 to 4 degrees, it may be preferable to have the shell extension 30 include a straight cylindrical section or an inverted cones section of about 3 to 4 degrees.

Returning to FIG. 1, the frame 44 may include any suitable convention building materials which typically would be steel, but could be aluminum, fiber reinforced plastic (FRP), wood, polymer, composite, etc. In an example, the membrane 42 includes a fabric stretched over the frame 44 with pretension cables that are attached to the fabric. The cables are then tensioned against the frame 44. The tension in the cable places a load approximately normal to the cable on the fabric and the fabric stretches.

The shell extension 30 may be anchored to the existing cooling tower 10 and/or the stiffening ring 32. The rim 18 is typically stiffened (larger section) to prevent the rim 18 from buckling under wind loads. If the rim 18 is sound, it may be used as-is to anchor the shell extension 30. Otherwise, the stiffening ring 32 may be used to replace or augment the existing rim 18.

Figure 3:
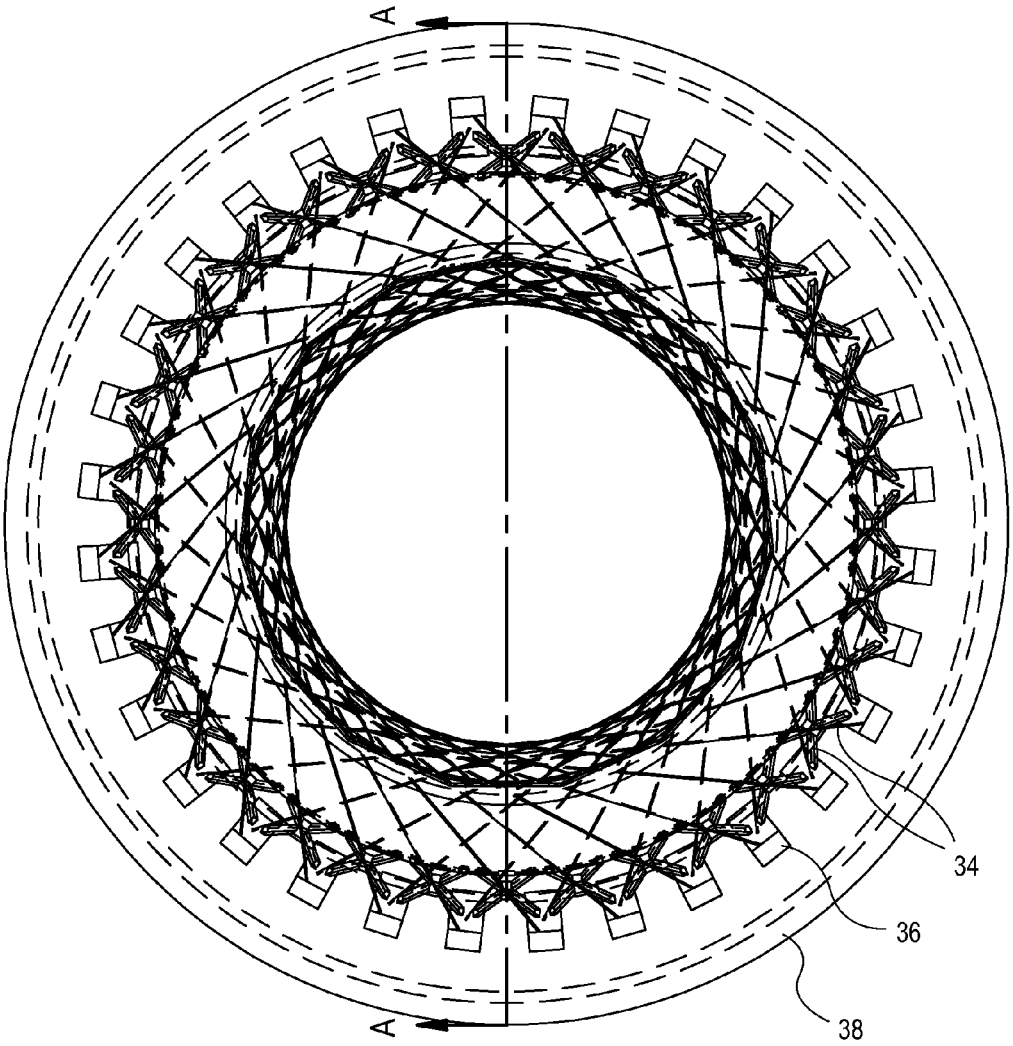
FIG. 3 is a top view of the cooling tower suitable for use with the shell extension system of FIG. 1.
Figure 4:
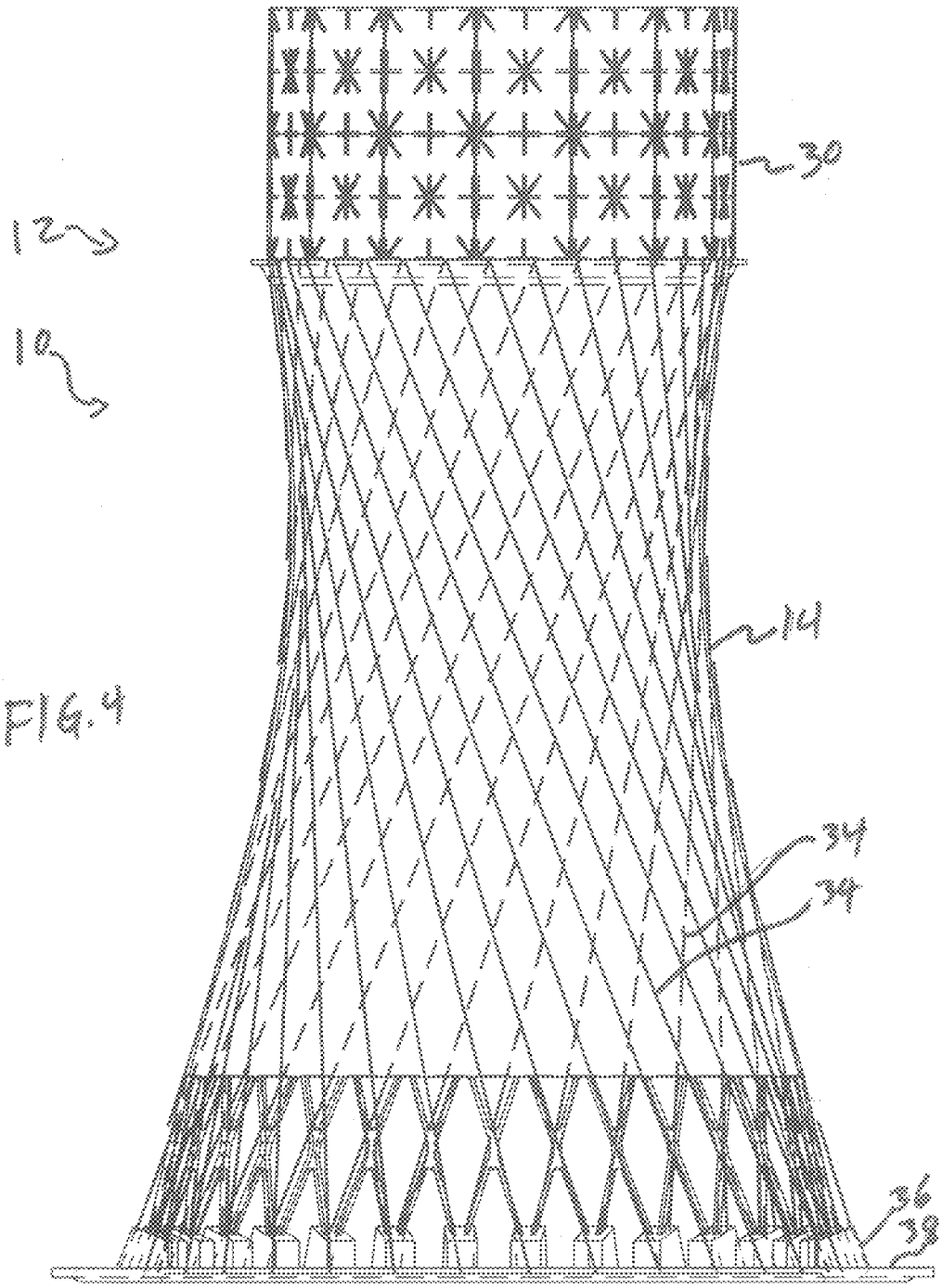
FIG. 4 is a cross sectional view A-A of the cooling tower suitable for use with the shell extension system of FIG. 1.

Wind loads applied to the shell extension 30 may be mitigated via the tensioners 34. Because the shell extension 30 is generally light weight compared to an equivalent concrete shell, wind uplift is of a particular concern. Adding additional wind uplift forces without balancing with equal gravity dead loads results in net uplift forces. Two approaches can be utilized to satisfy wind forces. In new construction, reinforcing steel may be added to the shell to accommodate the additional uplift from the shell extension 30. In existing cooling towers, the tensioners 34 may be utilized to translate the uplift to the ground or to the ballast 40. The tensioners 34 include any suitable material for translating a tension load from the stiffening ring 32 to the plinths 36, ballast 40 and/or the ground. Examples of suitable materials for the tensioners 34 include: steel and other metal cables; wires; carbon fibers or other fibers braided into lines; or other such materials. The tensioners 34 may be free or retained against the shell 14 with clips or other retaining device, for example, that permit free elongation of the tensioner but provide transverse restraint to prevent the tensioner from dynamic excitation. Tension in the tensioners 34 places the shell 14 in compression. When the additional uplift forces are applied, the pre-compression of the shell 14 is relieved. No additional demands are placed on the conventional steel reinforcing in the shell 14. Also noteworthy is the fact that where the wind load places compressive loads on the shell 14, the concrete of the shell 14 will elastically shorten due to the compression. This elastic shortening reduces the tension in the tensioners 34 resulting in little or no net compression in the shell 14 for the wind load. For shell geometries with straight line generators, the tensioners 34 desirably can be placed along these lines. For each tensioner 34 placed on the outside of the shell 14, an accompanying cable may be placed on the inside as shown in FIGS. 2-4 so as to apply the forces concentrically on the shell 14 to prevent twisting or bending of the shell 14. The inside tensioners 34 can be oriented to traverse the straight lines in the other direction so as not to torque the shell 14.

The plinths 36 support the bottoms of the columns 16 and also provide an anchor for the tensioners 34. In a particular example, the plinths 36 are reinforced concrete with inset cable anchors. The ring beam 38 facilitates distribution of loads from the plinths 36. The ballast 40 is optionally included to provide additional downward force to offset uplift. Alternatively the tensioners may be anchored to the ring beam.

The number of tensioners may be an even multiple of the plinths. The force resisted by each tensioner is the uplift force at each plinth divided by the number of tensioners per plinth. A service factor is applied to the uplift force or alternatively a load and resistance factor design (LRFD) method is applied to establish the required force capacity of the tensioner. Then a tensioner with a capacity equal to or greater than the required capacity could be selected. For example cable manufactures typically have load capacity tables for their products. The appropriate cable can be selected from the table.

To reduce applied wind forces on the cooling tower 10 and/or the shell extension system 12, a variety of steps may be taken. For example, in shells built without surface ribs or with very small surface ribs, an option is to consider making the surface more rough. Building codes for cooling towers prescribe a number of circumferential wind pressure distributions for different surface rib roughness. This may reduce the resulting forces in the shell. Also, older shells (before 1977) may have been designed with very conservative wind pressure coefficients. Applying new standards may prove the shell has capacity to accept the wind loads with the tension structure extension. In some cases it may be found that tensioners are not required to resist uplift due to reducing wind loads and/or because an overabundance of reinforcing was supplied in the original shell design.

To reduce applied wind forces, the shell extension 30 may include a wind bypass or one or more devices to vent wind. For example, retractable fabric or doors can be used to vent the frame work and reduce the wind loads. In advance of an approaching storm such as a hurricane, the shell extension 30 "skin" could be retracted or vented to reduce wind loads. Normally, natural draft towers have plenty of draft (air flow) in cool weather and the shell extension 30 may not be needed. In hot weather, many power plants experience maximum demand and the ND towers are least effective. As such, the shell extension 30 is most beneficial during hot weather. So, the shell extension 30 could be vented from fall through spring minimizing any risk to wind events during that time. The vent may be used alone or in combination with ribs or other roughness features to reduce wind loads. Furthermore, the tensioners 34 may be utilized to attach the ribs or other roughness features.

FIG. 2 is a hidden-line, elevation view of the cooling tower 10 suitable for use with the shell extension system 12 of FIG. 1. As shown in FIG. 2, the tensioners 34 on the exterior of the shell 14 are balanced by the tensioners 34 disposed in the interior of the shell 14. This balancing of the tensioners 34 is also shown in the top view of FIG. 3 and the cross section view of FIG. 4. Of note, the hidden lines of FIG. 4 show the tensioners 34 disposed on the exterior of the shell 14 and the solid lines represent the interior tensioners 34.

Figure 5:
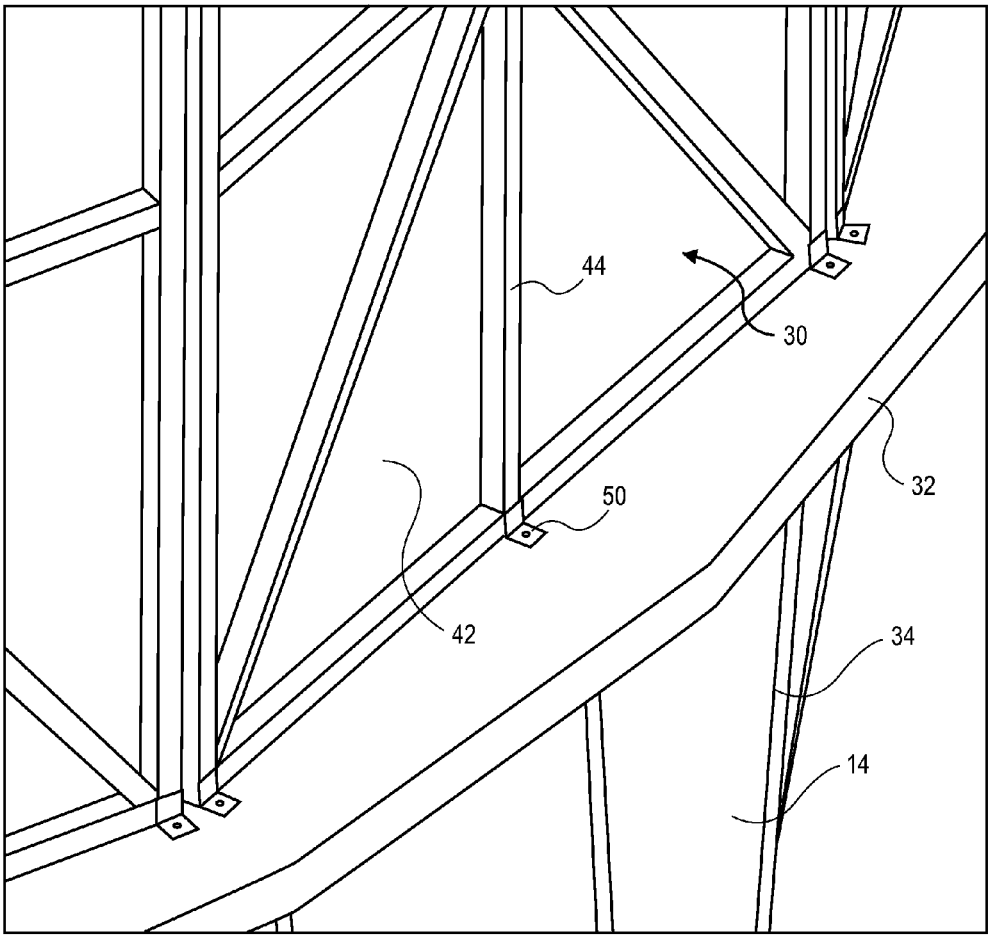
FIG. 5 is an elevation view of a detail of a shell extension installed on the cooling tower according to FIG. 1.

FIG. 5 is a perspective view of a detail of the shell extension 30 installed on the cooling tower 10 according to FIG. 1. As shown in FIG. 5, the frame 44 may be affixed to the stiffening ring 32 via a fastener 50. The fastener 50 includes any suitable device or technique for mounting one structure to another. Examples of suitable fasteners include bolts, screws, welds, adhesives, and/or the like. In a particular example, the fastener 50 includes a bolt extending from the stiffening ring 32 and nut to capture a flange member of the frame 44. In this manner, the shell extension 30 may be releaseably fastened to the cooling tower 10 by removing the nut.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A system for increasing a cooling capacity of a cooling tower, the system comprising:

a shell extension disposed at an upper rim of the cooling tower to extend a height of the cooling tower, wherein the cooling tower is an existing concrete cooling tower and the shell extension includes a frame secured to the upper rim and a membrane configured to cover the frame; and a tensioner to provide a tensioning force from the shell extension to a base of the cooling tower, the tensioner including a plurality of cables having respective first ends secured to the shell extension and respective second ends secured to the base.

2. The system according to claim 1, further comprising:

a plinth to secure the tensioner to the base.

3. The system according to claim 1, further comprising:

a ring beam to secure the tensioner to the base.

4. The system according to claim 1, further comprising:

a ring beam and a ballast disposed on the ring beam.

5. The system according to claim 1, further comprising:

a stiffening ring disposed at a rim of the cooling tower, the stiffening ring being configured to mount the shell extension and an attachment for the tensioner.

6. The system according to claim 1, wherein a first portion of the plurality of cables are disposed on an exterior of the cooling tower and a second portion of the plurality of cables are disposed on an interior of the cooling tower.

7. The system according to claim 1, wherein the shell extension includes a wind bypass.

8. A method of increasing a cooling capacity of an existing cooling tower, the method comprising the steps of:

installing a shell extension to an upper rim of the existing cooling tower to extend a height of the existing cooling tower, wherein the existing cooling tower is a concrete cooling tower and the shell extension includes a frame secured to the upper rim and a membrane configured to cover the frame; and determining if a wind load of the shell extension and the existing cooling tower is less than a designed wind load of the existing cooling tower; and installing a tensioner to provide a tensioning force from the shell extension in response to the wind load of the shell extension and the existing cooling tower exceeding the designed wind load, the tensioner including a plurality of cables having respective first ends secured to the shell extension and respective second ends secured to the base.

9. The method according to claim 8, further comprising:

roughening a surface of the existing cooling tower in response to the wind load of the shell extension and the existing cooling tower exceeding the designed wind load.

10. The method according to claim 8, further comprising:

installing a wind bypass in the shell extension in response to the wind load of the shell extension and the existing cooling tower exceeding the designed wind load.

* * * * *